US005494292A

United States Patent [19]

Mileti

[11] Patent Number: 5,494,292

[45] Date of Patent: Feb. 27, 1996

[54] MARBLE MAZE GAME DEVICE

[76] Inventor: Mark Mileti, P.O. Box 1458, Carmel Valley, Calif. 93924-1458

[21] Appl. No.: 465,991

[22] Filed: Jun. 6, 1995

[51] Int. Cl.[6] ..... A63F 9/08

[52] U.S. Cl. ..... 273/241; 273/280; 273/120 R; 273/110; 273/113; 273/155

[58] Field of Search ..... 273/241, 280, 273/120 R, 110, 155, 113

[56] References Cited

U.S. PATENT DOCUMENTS

| | | | |
|---|---|---|---|
| 2,839,303 | 6/1958 | Baker | 273/280 |
| 3,610,628 | 10/1971 | Promin | 273/138 R |
| 4,376,537 | 3/1983 | Yokoi | 273/153 S |
| 4,754,927 | 10/1986 | Boskovic | 273/113 |
| 4,822,049 | 4/1989 | Biber | 273/110 |
| 5,123,650 | 6/1992 | Slauter | 273/155 |

FOREIGN PATENT DOCUMENTS

| | | | |
|---|---|---|---|
| 2226767 | 7/1990 | United Kingdom | 273/241 |

*Primary Examiner*—Benjamin H. Layno

[57] ABSTRACT

A game device consisting of a plurality of vertically stacked, alternately rotatable disks (13, 25, 33, 41 and 49) and stationary tiers (10, 19, 29, 37, 45 and 53) each containing passageways through which a spherical game piece may pass. The disks are rotated by players in an effort to cause their respective game pieces to be the first to travel down through the device and drop into the tray (58) at the bottom. Windows (23) ape provided in the tiers so that players may track their progress through the device.

4 Claims, 3 Drawing Sheets

Fig. 3
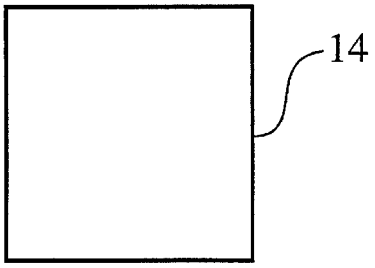
Fig. 4
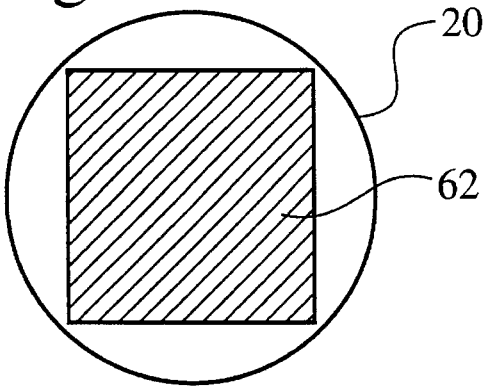
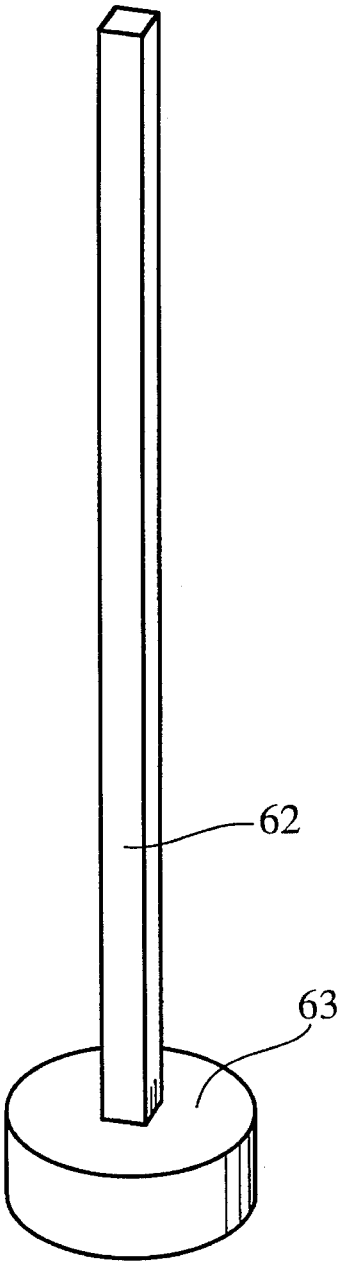
Fig. 5

MARBLE MAZE GAME DEVICE

BACKGROUND—FIELD OF INVENTION

This invention relates to game devices, specifically to mechanical game devices of the rotary-maze type.

BACKGROUND—DESCRIPTION OF PRIOR ART

Heretofore, several mechanical game devices of the rotary-maze type have been introduced. U.S. Pat. Nos. 772,281 to Jurado (1904), 4,376,537 to Yokoi (1983), 4,754,972 to Boskovic (1988), 4,822,047 to Treer (1989), 4,822,049 to Biber (1989) and 5,123,650 to Slauter (1992) all disclose a rotary maze game device employing a ball-like game piece. All of these devices were designed to be puzzles for only one player at a time. These devices do not provide fop multiple players to compete against each other simultaneously.

Another similar device has been designed for multiple player competition. U.S. Pat. 3,610,628 to Pnomin (1971) discloses a game apparatus consisting of vertically stacked rotatable elements through which may pass a ball-type game piece. The winner of this particular game is dictated entirely by chance.

OBJECTS AND ADVANTAGES

Accordingly several objects and advantages of the present invention are:

(a) to provide a game device fop multiple simultaneous players;

(b) to provide a game that combines skill and chance to determine the winner;

(c) to provide a game that can be learned and played relatively quickly by both sophisticated and unsophisticated players;

(d) to provide a game device which allows a player to track his progress throughout the game by providing a series of different levels with visible chambers in which a player's game piece rests in between turns;

(e) to provide the possibility of temporarily hiding the player's piece within the device to make it more difficult for opponents to determine his position;

(f) to provide the possibility of temporarily holding an opponent's piece in an attempt to cause him to forget its location; and (g) to provide a game device that has an interesting physical appearance so as to entice new players.

These and other objects and advantages of the present invention will appear from time to time as the following specifications proceed and with reference to the accompanying drawings.

DRAWING FIGURES

FIG. 3 is a top plan view of the square center hole in parts 10, 19, 29, 37, 45, 53 and 58.

FIG. 4 is a top plan view of the circular center hole in parts 13, 25, 33, 41 and 49.

FIG. 5 is a perspective view of the central shaft.

| | |
|---|---|
| 10 starting cup | 11 bores of 10 |
| 12 boss of 10 | 13 first rotatable disk |
| 14 square center hole | 15 counterbore of 13 |
| 16 bore of 13 | 17 indicia |
| 18 boss of 13 | 19 first tier |
| 20 circular center hole | 21 counterbore of 19 |
| 22 passageway of 19 | 23 windows |
| 24 boss of 19 | 25 second rotatable disk |
| 26 counterbore of 25 | 27 bore of 25 |
| 28 boss of 25 | 29 second tier |
| 30 counterbore of 29 | 31 passageway of 29 |
| 32 boss of 29 | 33 third rotatable disk |
| 34 counterbore of 33 | 35 bore of 33 |
| 36 boss of 33 | 37 third tier |
| 38 counterbore of 37 | 39 passageway of 37 |
| 40 boss of 37 | 41 fourth rotatable disk |
| 42 counterbore of 41 | 43 bore of 41 |
| 44 boss of 41 | 45 fourth tier |
| 46 counterbore of 45 | 47 passageway of 45 |
| 48 boss of 45 | 49 fifth rotatable disk |
| 50 counterbore of 49 | 51 bore of 49 |
| 52 boss of 49 | 53 fifth tier |
| 54 upper counterbore of 53 | 55 bore of 53 |
| 56 lower counterbore of 53 | 57 primary boss of 58 |
| 58 winner's tray | 59 secondary boss of 58 |
| 60 perimeter wall of 58 | 61 channel of 58 |
| 62 central shaft | 63 lower shaft cap |
| 64 upper shaft cap | |

DESCRIPTION—FIGS. 1 TO 5

Figure 1:
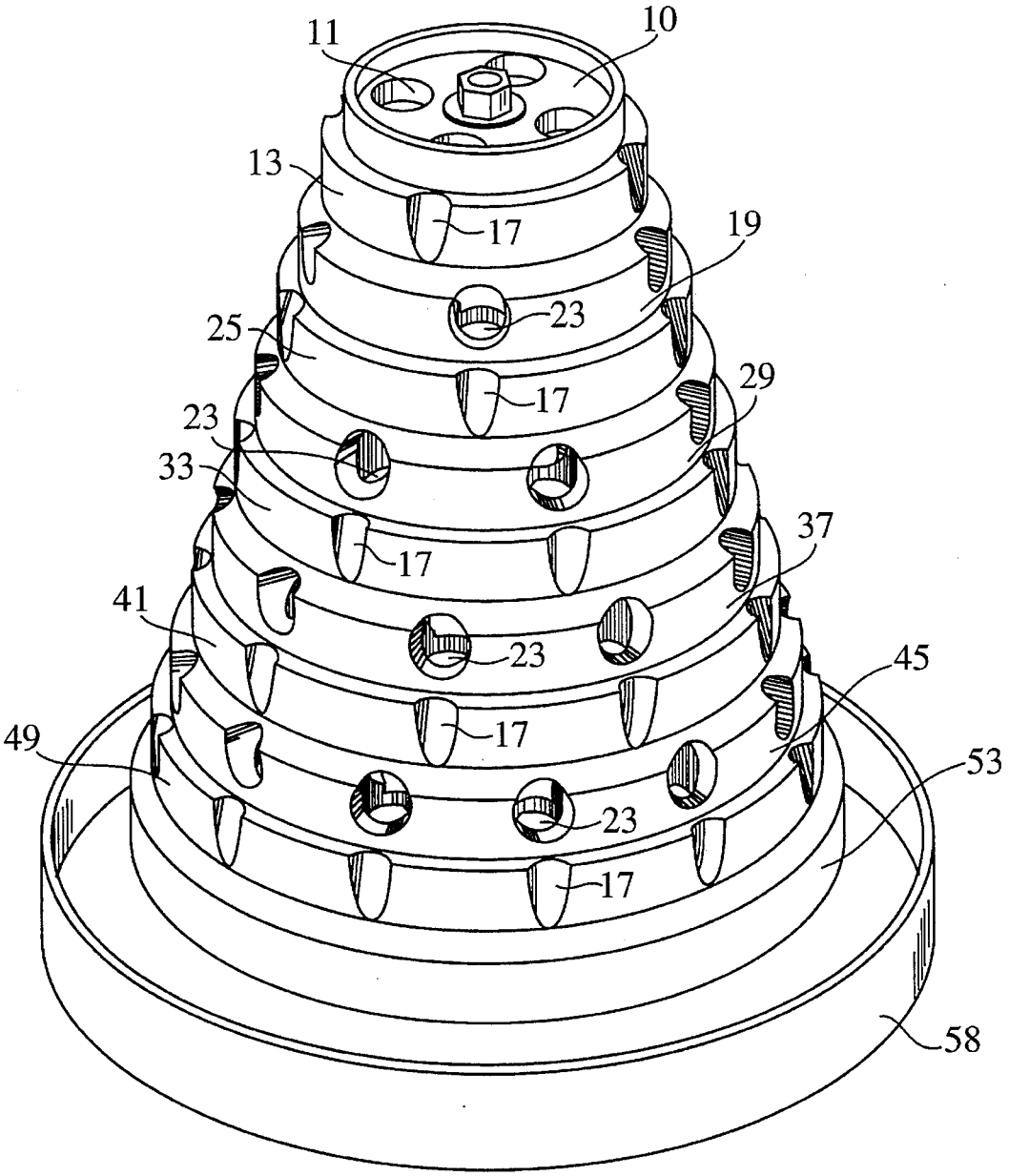
FIG. 1 is a perspective view of the game device.
Figure 2:
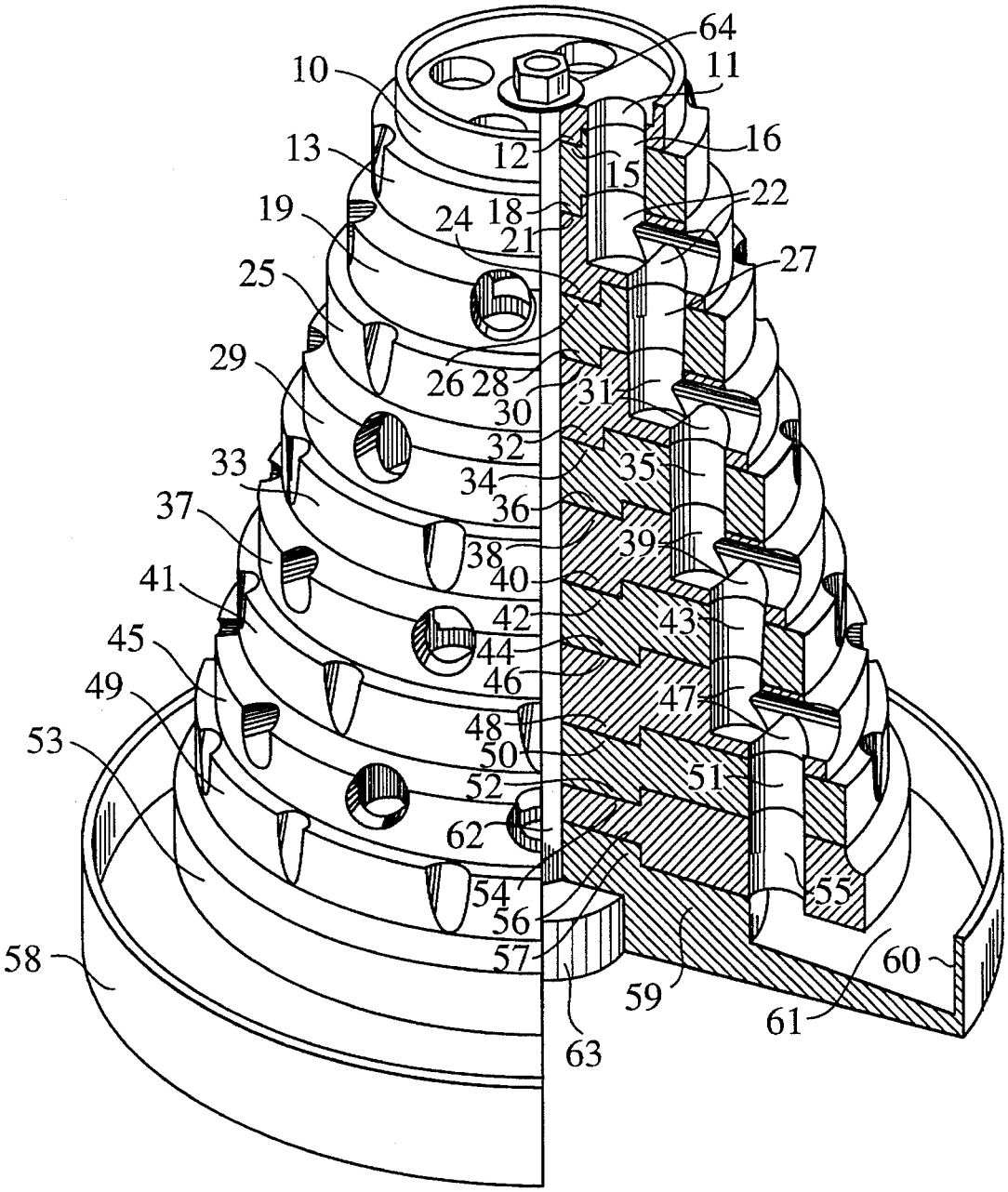
FIG. 2 is a perspective view of the game device partially broken away to illustrate the interior.

A typical embodiment of the game device of the present invention is illustrated in FIGS. 1 and 2. The game device consists of a disc-shaped starting cup 10 in FIG. 1. Cup 10 contains four vertical bores 11. Bores 11 are of sufficient diameter so as to allow the easy passage of a spherical game piece. Bores 11 are arrayed 90 degrees apart and located equidistance radially from center of cup 10. Located on the center of the bottom surface of cup 10 is a disk-like boss 12 in FIG. 2. A square hole 14 in FIG. 3 passes vertically through the center of cup 10. Boss 12 extends down into a disc 13.

Disk 13 in FIG. 2 is a disk with a greater overall diameter than that of cup 10. Disk 13 is located directly below cup 10. Disk 13 contains a centered counterbore 15 on its upper surface equal in dimension to boss 12. Disk 13 contains two vertical bores 16 of similar diameter to bores 11. Bores 16 are located on the same radius from the center of disk 13 as bores 11. Bores 16 are arrayed 180 degrees apart, The thickness of disk 13 is slightly greater than the diameter of a game piece. On the outer edge of disk 13 are four indicia 17 in FIG. 1 arrayed 90 degrees apart. Each bore 16 is located equidistant between two adjacent indicia 17. Centered on the bottom surface of disk 13 is a disc-like boss 18. Through the center of disk 13 is a circular hole 20 in FIG. 4 which passes vertically through disk 13. Boss 18 protrudes down into a tier 19.

Tier 19 is a disc with an overall diameter greater than that of disk 13. It is located directly below disk 13. Tier 19 contains a centered counterbore 21 on its upper surface equal in dimension to boss 18. Tier 19 contains five separate passageways 22 arrayed 72 degrees apart. Passageways 22 are equal in diameter to bores 11 and 16. Passageways 22 originate on the top surface of tier 19 on the same radius as bores 11 and 16. Passageways 22 terminate on the lower surface of tier 19 a radial distance from the center greater than their point of origin. A window 23 is provided fop each individual passageway 22 in the outer edge of tier 19. The thickness of tier 19 is such that two game pieces could fit within the passageway without the uppermost piece protruding above the top surface of tier 19. Centered on the lower surface of tier 19 is a disk-like boss 24. A square hole 14 passes vertically through the center of tier 19. Boss 24 protrudes down into a disk 25.

Disc 25 is a disk with a greater overall diameter than that of tier 19. Disk 25 is located directly below tier 19. Disk 25 contains a centered counterbore 26 on its upper surface equal in dimension to boss 24. Disk 25 contains two vertical bores 27 of similar diameter to bores 11. Bores 27 are located on the same radius from the center of disk 25 as lower exit of passageway 22 in tier 19. Bores 27 are arrayed 144 degrees apart. The thickness of disk 25 is slightly greater than the diameter of a game piece. On the outer edge of disk 25 are five indicia 17 in FIG. 1 arrayed 72 degrees apart. Each bore 27 is located equidistant between two adjacent indicia 17. Centered on the bottom surface of disk 25 is a disc-like boss Through the center of disk 25 is a circular hole 20 in FIG. 4 which passes vertically through disk 25. Boss 28 protrudes down into a tier 29.

Tier 29 is a disc with an overall diameter greater than that of disk 25. It is located directly below disk 25. Tier 29 contains a centered counterbore 30 on its upper surface equal in dimension to boss 28. Tier 29 contains seven separate passageways 31 arrayed 51.43 degrees apart. Passageways 31 are equal in diameter to bores 11 and 16. Passageways 31 originate on the top surface of tier 29 on the same radius as bores 27. Passageways 31 terminate on the lower surface of tier 29 a radial distance from the center greater than their point of origin. A window 23 in FIG. 1 is provided for each individual passageway 31 in the outer edge of tier 29. The thickness of tier 29 is such that two game pieces could fit within the passageway 31 without the uppermost piece protruding above the top surface of tier 29. Centered on the lower surface of tier 29 is a disk-like boss 32. A square hole 14 in FIG. 3 passes vertically through the center of tier 29. Boss 32 protrudes down into a disk 33.

Disc 33 is a disk with a greater overall diameter than that of tier 29. Disk 33 is located directly below tier 29. Disk 33 contains a centered counterbore 34 on its upper surface equal in dimension to boss 32. Disk 33 contains two vertical bores 35 of similar diameter to bores 11. Bores 35 are located on the same radius from the center of disk 33 as the lower exit of passageway 31 in tier 29. Bores 35 are arrayed 154.26 degrees apart. The thickness of disk 33 is equal to the thickness of disk 13. On the outer edge of disk 33 are seven indicia 17 in FIG. 1 arrayed 51.42 degrees apart. Each bore 35 is located equidistant between two adjacent indicia 17. Centered on the bottom surface of disk 33 is a disc-like boss 36. Through the center of disk 33 is a circular hole 20 in FIG. 4 which passes vertically through disk 33. Boss 36 protrudes down into a tier 37.

Tier 37 is a disc with an overall diameter greater than that of disk 33. It is located directly below disk 33. Tier 37 contains a centered counterbore 38 on its upper surface equal in dimension to boss 36. Tier 37 contains nine separate passageways 39 arrayed 40 degrees apart. Passageways 39 are equal in diameter to bores 11 and 16. Passageways 39 originate on the top surface of tier 37 on the same radius as bores 35. Passageways 39 terminate on the lower surface of tier 37 a radial distance from the center greater than their point of origin. A window 23 in FIG. 1 is provided for each individual passageway 39 in the outer edge of tier 37. The thickness of tier 37 is equal to the thickness of tier 29. Centered on the lower surface of tier 37 is a disk-like boss 40. A square hole 14 in FIG. 3 passes vertically through the center of tier 37. Boss 40 protrudes down into a disk 41.

Disc 41 is a disk with a greater overall diameter than that of tier 37. Disk 41 is located directly below tier 87. Disk 41 contains a centered counterbore 42 on its upper surface equal in dimension to boss 40. Disk 41 contains two vertical bores 43 of similar diameter to bores 11. Bores 43 are located on the same radius from the center of disk 41 as the lower exit of passageway 39 in tier 37. Bores 43 are arrayed 160 degrees apart. The thickness of disk 41 is equal to the thickness of disk 13. On the outer edge of disk 41 are nine indicia 17 in FIG. 1 arrayed 40 degrees apart. Each bore 43 is located equidistant between two adjacent indicia 17. Centered on the bottom surface of disk 41 is a disc-like boss 44. Through the center of disk 41 is a circular hole 20 in FIG. 4 which passes vertically through disk 41. Boss 44 protrudes down into a tier 45.

Tier 45 is a disk with an overall diameter greater than that of disk 41. It is located directly below disk 41. Tier 45 contains a centered counterbore 46 on its upper surface equal in dimension to boss 44. Tier 45 contains twelve separate passageways 47 arrayed 30 degrees apart. Passageways 47 are equal in diameter to bores 11 and 16. Passageways 47 originate on the top surface of tier 45 on the same radius as bores 43. Passageways 47 terminate on the lower surface of tier 45 a radial distance from the center greater than their point of origin. A window 23 in FIG. 1 is provided for each individual passageway 47 in the outer edge of tier 45. The thickness of tier 45 is equal to the thickness of tier 29. Centered on the lower surface of tier 45 is a disk-like boss 48. A square hole 14 in FIG. 3 passes vertically through the center of tier 45. Boss 48 protrudes down into a disk 49.

Disk 49 is a disk with a greater overall diameter than that of tier 45. Disk 49 is located directly below tier 45. Disk 49 contains a centered counterbore 50 on its upper surface equal in dimension to boss 48. Disk 49 contains one vertical bore 51 of similar diameter to bores 11. Bore 51 is located on the same radius from the center of disk 49 as the lower exit of passageway 47 in tier 45. The thickness of disk 49 is equal to the thickness of disk 13. On the outer edge of disk 49 are twelve indicia 17 in FIG. 1 arrayed 30 degrees apart. Bore 51 is located equidistant between two adjacent indicia 17. Centered on the bottom surface of disk 49 is a disc-like boss 52. Through the center of disk 49 is a circular hole 20 in FIG. 4 which passes vertically through disk 49. Boss 52 protrudes down into a tier 53.

Tier 53 is a disc with an overall diameter greater than that of disk 49. It has a thickness equal to tier 19. Tier 53 has a centered counterbore 54 on its upper surface equal in dimension to boss 52. Tier 53 contains twelve vertical bores 55 arrayed 30 degrees apart. Bores 55 are located on the same radius as bore 51. Centered on the bottom surface is a counterbore 56. A square hole 14 in FIG. 3 passes vertically through the center of tier 53.

Winner's tray 58 is a circular tray with a greater overall diameter than that of tier 53. It is located directly below tier 53. Centered on the upper surface of tray 58 protrudes a disc-like boss 57. Boss 57 is equal in dimension to counterbore 56 and protrudes up into it. Boss 57 is centered on top of a secondary disc-like boss 59. Boss 59 has a greater diameter and thickness than boss 57. The outer perimeter of tray 58 has a circular, vertical wall 60 surrounding a circular channel 61 between boss 59 and wall 60. The trough of channel 61 slopes from boss 59 down to the base of wall 60. A square hole 14 in FIG. 3 passes vertically through the center of tray 58.

Shaft 62 in FIG. 5 passes through the center holes described above in cup 10, disks 13, 25, 33, 41, 49, tiers 19, 29, 37, 45, 53 and tray 58. It consists of a square shaped rod 62 with a diameter slightly less than hole 20 and equal to hole 14 in FIGS. 3 and 4. Shaft 62 is capped on the bottom 63 and top 64 ends as shown in FIG. 2.

Operation—FIGS. 1 to 5

Shaft 62 holds cup 10, tiers 19, 29, 37, 45, 53 and tray 58 stationary while allowing disks 13, 25, 33, 41, and 49 to be independently rotated. The disks are capable of clockwise or counterclockwise rotation about a central axis provided by the series of bosses and counterbores.

This series of bosses and counterbores additionally provides horizontal stability for the device to insure proper alignment of the various bores and passageways during play.

Discs 25, 33, 41, and 49 are properly aligned for play when the indicia 17 on those discs are positioned directly below the windows of the tier directly above that particular disc as shown in FIG. 1. Disc 13 is properly aligned when the indicia 17 on disc 13 are positioned adjacent to bores 11 as illustrated in FIG. 1. When properly aligned the game pieces will rest in bores 11 on the top surface of disc 13, or in windows 23 of passageways 22, 31, 39, or 47 on the top surface of discs 25, 33, 41, or 49 respectively.

The game begins with each player placing a game piece into a bore 11 of starting cup 10. Balls of different colors are used as game pieces so that players may easily distinguish their corresponding game piece during play. It is the player's objective to cause his individual game piece to be the first to drop into the winner's tray 58 at the bottom of the game device.

Players take turns rotating a single disk such that indicium 17 below any given window 23 is moved to a position directly below either of the two adjacent windows. The disk is now properly aligned for the subsequent player's turn. The number of degrees of rotation allowable per turn depends upon which disk is being rotated. Disk 13 allows 90 degrees, disk 25 allows 72 degrees, disk 33 allows 51.42 degrees, disk 41 allows 40 degrees and disk 49 allows 30 degrees of rotation per turn.

During rotation, a bore in the rotating disk may pass under a game piece causing it to drop down through the disk and into a windowed passageway 23. It would remain there until a bore in the disk directly below it is successfully positioned enabling it to drop further, thus gaining a position closer to winners tray 58.

Passageway windows 23 enable the players to track the progress of their game piece as well as the progress of their opponents' game piece(s) through the game device. A secondary function of windows 23 is to enable the players to possibly determine the location or probable location of a disc bore while rotation is occurring.

Due to the design of this particular embodiment of this game device it is possible for a game piece to become temporarily lost from sight in one of two ways:

(a) A game piece may drop into a bore of the rotating disk but not drop into a passageway below due to limited disk rotation; and (b) A game piece may enter a passageway already occupied by another piece, thus getting "backed up" behind that piece.

The game progresses with players taking turns rotating disks and maneuvering their individual game pieces downward in an attempt to cause their game piece to be the first to drop into the winner's tray 58 at the bottom of the game device. With each progressive move downward, the game piece also moves radially toward the perimeter of the device through the passageways in the tiers before lodging in passageway windows 23. This lateral movement enables the game device to be designed such that the probability of a subsequent move downward attributable to chance become less due to the decreasing allowable arc of rotation per player turn of the lower disks.

Disc 49 is the last rotatable disk above winner's tray 58. It is designed with only one bore 51 to avoid the possibility of a tie between competing players.

Tier 53 is the last stationary tier above winner's tray 58. It is the only tier without passageway windows. Its vertical bores 55 provide a downward passageway to winner's tray 58 without directing the game piece laterally. The primary function of tier 53 is to prevent players from touching the underside of disk 49 in an attempt to determine the location of bore 51 in disk 49.

Summary, Ramifications and Scope

While my above description contains many specificities, these should not be construed as limitations on the scope of the invention, but rather as an exemplification of one preferred embodiment thereof.

Other variations are possible. For example, altering the number of bores in starting cup 10 to either increase or decrease the maximum number of simultaneous players; the total number of rotatable disks and stationary tiers could be altered to either increase or decrease the complexity of the game; altering the number of bores in the disks; altering the number of passageways in the tiers; the deletion of some or all of the windows in the passageways can also affect the complexity and time required to complete the game. The device can also be designed to be operated other than manually. The device can be designed of any size to accommodate spherical game pieces of a certain desired dimension or composition. Center shaft 62 and center holes 14 and 20 can be designed to provide a locking/unlocking mechanism for the rotatable disks. This will eliminate the need for indicia and prevent the possibility of turning a disk too far.

Accordingly, the scope of my game device should be determined not by the embodiment(s) illustrated, but by the appended claims and their legal equivalents.

I claim:

1. A game device comprising a plurality of opaque individually rotatable disks vertically and alternately stacked between a plurality of stationary disk-like tiers; a plurality of spherical game pieces said rotatable disks and tiers having a plurality of individual passageways through which said spherical game pieces may drop when said disks are rotated, said spherical disk having a thickness greater than the diameter of said spherical game pieces, wherein said spherical game pieces are concealed from view when contained within the passageways of said rotatable disks, and said individual tier passageways each contain a window to view said game pieces when said game pieces are contained within said tier passageways; said tiers being held stationary in relation to said disks by means of a central shaft passing through the center of said disks and tiers.

2. The game device of claim 1 wherein means are provided for limiting degrees of rotation of said disks.

3. The game device of claim 2 wherein indicia are located on the outer periphery of said disks to provide a means for limiting the degrees of rotation of said disks.

4. The game device of claim 1 which is conical in shape.

* * * * *